US008543036B2

(12) United States Patent
Nakamura

(10) Patent No.: US 8,543,036 B2
(45) Date of Patent: Sep. 24, 2013

(54) IMAGE FORMING APPARATUS WITH PRIMARY AND SECONDARY TRANSFER SECTIONS

(75) Inventor: Masakazu Nakamura, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 276 days.

(21) Appl. No.: 13/040,700

(22) Filed: Mar. 4, 2011

(65) Prior Publication Data

US 2011/0222907 A1 Sep. 15, 2011

(30) Foreign Application Priority Data

Mar. 10, 2010 (JP) ..... 2010-052758

(51) Int. Cl.
*G03G 15/16* (2006.01)
*G03G 15/01* (2006.01)

(52) U.S. Cl.
USPC ..... 399/121; 399/302

(58) Field of Classification Search
USPC ..... 399/121, 302, 313
See application file for complete search history.

(56) References Cited

FOREIGN PATENT DOCUMENTS

| | | | |
|---|---|---|---|
| JP | 2005316320 A | * | 11/2005 |
| JP | 2007-286382 A | | 11/2007 |
| JP | 2007-316427 A | | 12/2007 |

* cited by examiner

*Primary Examiner* — G. M. Hyder
(74) *Attorney, Agent, or Firm* — Cantor Colburn LLP

(57) ABSTRACT

An image forming apparatus capable of reducing deterioration of image quality caused by instantaneous fluctuation of driving speed of an image bearing member and intermediate transfer member, the apparatus including: an image bearing member; a primary transfer section to transfer toner image from the image bearing member onto an intermediate transfer member; a secondary transfer section, including a secondary transfer member to secondarily transfer the toner image from the intermediate transfer member onto a recording medium, capable of bringing the secondary transfer member into contact with the intermediate transfer member under pressure and then releasing the contact; a motor to drive the secondary transfer member, and a driving section configured to drive the secondary transfer section so as to bring the secondary transfer member into contact with the intermediate transfer member with pressure and then to release the contact, wherein the motor is not provided inside the secondary transfer section.

2 Claims, 4 Drawing Sheets

IMAGE FORMING APPARATUS WITH PRIMARY AND SECONDARY TRANSFER SECTIONS

This application is based on Japanese Patent Application No. 2010-052758 filed on Mar. 10, 2010 with the Japanese Patent Office, the entire content of which is hereby incorporated by reference.

TECHNICAL FIELD

The present invention relates to an image forming apparatus, that is, to an image forming apparatus which forms an image on a recording medium by, for example, an electrophotographic method.

BACKGROUND OF THE INVENTION

Heretofore, known as image forming apparatuses such as electro-photographic copying machines, printers, facsimiles, and the like, to transfer a toner image on an electro-photographic photoconductor (hereinafter also referred simply to as a photoconductor) onto a recording medium to form a final image, has been a system which transfers a toner image, formed on a photoconductor, directly onto a recording medium. Further, known has been an image forming system employing an intermediate transfer body. In the latter system, another transfer process is included which transfers a toner image from the photoconductor onto a recording medium, and after performing the primary transfer from photoconductor onto the intermediate transfer body, the primary transfer image on the intermediate transfer body is subjected to secondary transfer onto another recording medium, whereby a final image is produced. In the place where secondary transfer onto a recording medium is carried out, there is often provided a secondary transfer roller or secondary transfer belt which faces the intermediate transfer body and forms a nip therebetween. The method using an intermediate transfer device is often utilized as a superimpose transfer method of each color toner image in so-called a full-color image forming apparatus in which an original image which has been separated into colors is reproduced employing the color subtractive process using color toners such as yellow (Y) toner, magenta (M) toner, cyan (C) toner, and black (K) toner.

According to such an image forming apparatus, a peculiar problem has been known in which the rotation speed of photoconductor or intermediate transfer body is varied at the moment when a recording medium is fed into, or fed out from, the transfer section where transfer of a toner image from photoconductor or intermediate transfer body onto a recording medium is carried out, the recording medium causes an instantaneous impact onto the photoconductor and intermediate transfer body resulting in fluctuations of load torque.

This problem, mentioned above, often introduces the misalignment of transferred image in the primary transfer and an uneven exposure onto photoconductor during exposure process, resulting in the deterioration of image quality.

Accordingly, techniques to solve the above-mentioned problem have been proposed by the following patent documents.

For example, Japanese Patent Application No. 2007-316427 discloses an embodiment in which such adverse effect, caused by the impact by recording medium to transfer section, is prevented by controlling the pressure to be applied to the secondary transfer roller, which forms a nip in the transfer section, in accordance with the timing of feed-in and feed-out of the recoding material, by using a piston cylinder encapsulating a fluid of which viscosity changes according to the applied electrical field, or magnetic field.

Also, Japanese Patent Application No. 2007-286382 discloses an embodiment in which drastic decline of the rotation speed of intermediate transfer body driving motor is prevented by control to reduce the pressure to be applied to the secondary transfer roller, by providing a pressure adjusting means which adjusts pressure to be applied to the secondary transfer roller which forms a nip for secondary transfer by being abutted to the intermediate transfer body, at the moment when a recording medium is fed into the secondary transfer nip.

According to the above mentioned patent documents, however, it is necessary to provide a mechanical structure and an electrical control for exclusive use. Also, it is often difficult to detect the exact timing of when a recording medium is fed into the transfer section and fed out, and to control the transfer pressure to increase or decrease at the moment when the recording medium is fed in or fed out, in response to a wide variety of recording mediums.

Furthermore, in a case in which the entire secondary transfer section, which consists of a secondary transfer belt, a driving motor to drive the secondary transfer belt, a driven roller, a tension roller, a cleaning section to clean off residual toner, and the like, is driven in order to form a secondary transfer nip, the weight of the entire secondary transfer section increases, and therefore, resulting in problem in that the secondary transfer section vibrates widely when a recording medium is fed in, and also, it takes longer time for the vibration to settle down.

SUMMARY OF THE INVENTION

The present invention has been made in consideration of the above problems, and it is one of the main objects to provide an image forming apparatus capable of appropriately suppressing the deterioration of image quality caused by an instantaneous fluctuation of the driving speed of the intermediate transfer body, and the photoconductor.

The above object of the present invention was achieved employing the following constitutions.

[1] An image forming apparatus reflecting one aspect of the present invention includes, for example, but is not limited to: a) an image bearing member, a primary transfer section to transfer a toner image, formed on the image bearing member, onto an intermediate transfer member; b) a secondary transfer section, which is provided with a secondary transfer member to secondarily transfer the toner image, formed on the intermediate transfer member, onto a recording medium while the secondary transfer member rotates, and is configured so as to be capable, by rotating around a fulcrum point as a rotation center, of bringing the secondary transfer member into contact with the intermediate transfer member under pressure and then releasing the contact, and of generating a nip between the intermediate transfer member and the secondary transfer member under a pressure contact condition; c) a motor to drive secondary transfer member to rotate; d) and a driving section which is configured to drive the secondary transfer section so as to bring the secondary transfer member into contact with the intermediate transfer member under pressure, and to release the contact, wherein the motor is not provided inside the secondary transfer section.

[2] The image forming apparatus of [1] reflecting another aspect of the present invention, further includes a gear which rotates around the fulcrum point as a rotation center, wherein the driving force of the motor is transmitted to the secondary transfer member via the gear.

[3] The image forming apparatus of [1] reflecting still another aspect of the present invention, wherein the secondary transfer section includes therein a cleaning section to remove a toner on the secondary transfer member after secondary transfer.

DETAILED DESCRIPTION OF THE PREFERRED EMBODIMENTS

Below an embodiment of the present invention will now be described in detail with reference to the accompanying drawings. Note that the present invention can be applied to an image forming apparatus such as a printer which is not equipped with an image reading means such as a scanner, as well as to an image forming apparatus such as a copier which is equipped with an image reading means such as a scanner.

A preferred embodiment of the present invention will now be described with reference to an electro-photographic copying machine as an image forming apparatus in this example.

Figure 1:
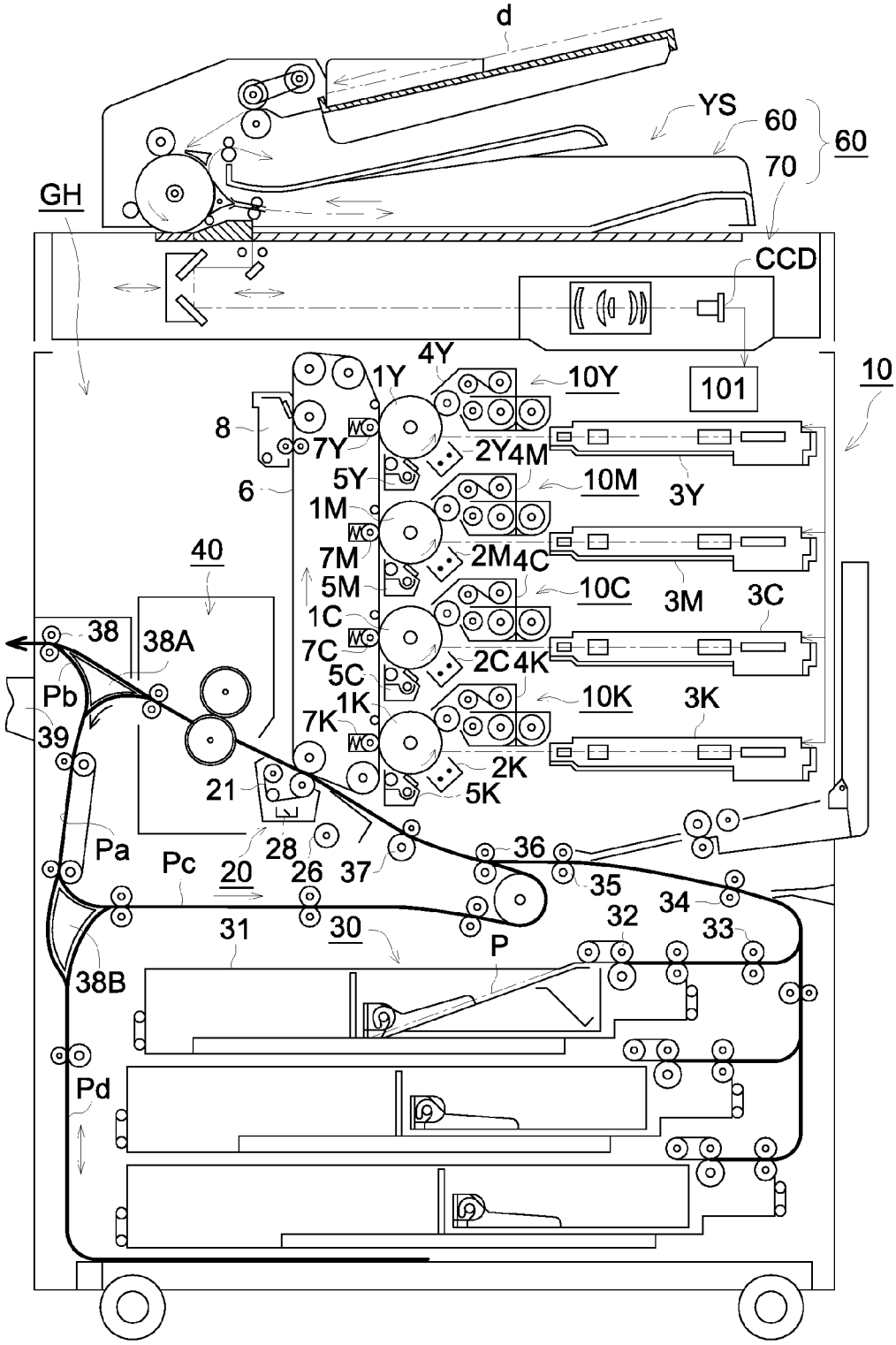
FIG. 1 is a cross-sectional diagram schematically showing an example of an image forming apparatus according to an embodiment of the present invention.

FIG. 1 is an overall structural view of an image forming apparatus according to the embodiment of the present invention.

The present image forming apparatus consists of image forming apparatus main body GH and image reading apparatus YS.

Image forming apparatus main body GH is a so-called tandem type color image forming apparatus, consisting of image forming section 10, which consists of a plurality of image forming devices 10Y, 10M, 10C, and 10K and intermediate transfer belt 6 which is an intermediate transfer body in a shape of a belt, secondary transfer section 20, sheet feeding section 30, and fixing section 40.

Image forming section 10 and secondary transfer section 20 form a toner image on a recording medium (hereinafter, referred to as recording sheet P) which is fed from sheet feeding section 30, and then, convey recording sheet P to fixing section 40.

At an upper portion of image forming apparatus main body GH, image reading apparatus YS, consisting of automatic document feeder 60 and document reading section 70, is provided.

Original document "d", placed on a platen of automatic document feeder 60, is conveyed by a conveyance mechanism and images on a single side or both sides of the document are scanned and exposed through an optical system of document reading section 70, then the images are read by a line image sensor CCD (Charge-Coupled Device).

A signal created by photoelectric conversion through the line image sensor CCD is sent to exposing devices (exposure optical units) 3Y, 3M, 3C, and 3K after being processed through analogue processing, A/D conversion, shading correction, and image compression.

Image forming section 10Y, to form a yellow color image, is provided with charging device 2Y, exposing device 3Y, developing device 4Y and cleaning device 8Y on the periphery of photoconductive drum 1Y representing an image bearing member. Image forming section 10M, to form a magenta color image, is provided with charging device 2M, exposing device 3M, developing device 4M, and cleaning device 8M on the periphery of photoconductive drum 1M representing an image bearing member. Image forming section 10C, to form a cyan color image, is provided with charging device 2C, exposing device 3C, developing device 4C, and cleaning device 8C on the periphery of photoconductive drum 1C representing an image bearing member. Image forming section 10B, to form a black color image, is provided with charging device 2K, exposing device 3K, developing device 4K, and cleaning device 8K on the periphery of photoconductive drum 1K representing an image bearing member. Charging device 2Y and exposing device 3Y, charging device 2M and exposing device 3M, charging device 2C and exposing device 3C, and charging device 2K and exposing device 3K each form a latent image forming device.

Meanwhile, developing devices 4Y, 4M, 4C, and 4K each contain two-component developer consisting of a small particle toner of yellow (Y), magenta (M), cyan (C), and black (K), and a carrier, respectively.

Thereby, each color of an image formed by image forming sections 10Y, 10M, 10C, and 10K is successively transferred onto intermediate belt 6, which is an intermediate transfer body configured to rotate, through primary transfer devices 7Y, 7M, 7C, and 7K, to form a superimposed color toner image.

Recording sheet P stored in sheet feeding tray 31 of sheet feeding section 30 is fed by sheet feeding device 32 and conveyed through sheet feeding rollers 33, 34, 35, 36, and registration roller 37, which once stops recording sheet P and then starts to rotates to feed recording sheet P at a timing in which positional relation between the front edge of recording sheet P and the color image on intermediated transfer belt 6 is accurately matched, to secondary transfer section 20, and then the color image formed on intermediate transfer belt 6 is transferred onto recording sheet P (called secondary transfer).

Intermediate transfer belt 6, which is wound around a plurality of rollers and supported rotatably, functions as an intermediate transfer body.

Recording sheet P, onto which a color image has been transferred, is nipped in fixing unit 40, and the color toner image (or the toner image) on recording sheet P is fixed onto recording sheet P by the application of heat and pressure, and then recording sheet P is ejected onto exit tray 39 outside the apparatus after being gripped by ejection roller 38.

In the meantime, after the color image has been transferred onto recording sheet P by secondary transfer section 20, recording sheet P is subjected to curvature separation by intermediate transfer belt 6. Any residual toner remaining on intermediate transfer belt 6, after secondary transfer, is removed by a cleaning blade (not shown) inside cleaning device 8. Any residual toner remaining on secondary transfer belt 21 of secondary transfer section 20, after secondary transfer, is removed by a cleaning blade (not shown) inside cleaning device 28, which is installed in the interior of secondary transfer section 20.

When recording sheet P, on which the toner image has been fixed, is to be ejected in a reverse ejection mode, recording sheet P is branched off at branching plate 38A, which is placed between fixing unit 40 and ejection roller 38, and conveyed toward first conveyance path Pa. After recording sheet P is conveyed to first conveyance path Pa, then recording sheet P is subject to switchback and conveyed back toward second conveyance path Pb from first conveyance path Pa, and ejected onto exit tray 39 outside the apparatus.

When toner images are to copied on the both surfaces of recording sheet P, after the toner image formed on the first surface of recording sheet P is fixed onto recording sheet P, recording sheet P is conveyed into first conveyance path Pa and further conveyed into fourth conveyance path Pd, which is located downward of branching plate 38B and where recording sheet P is subject to switchback. Then, recording sheet P is conveyed back into third conveyance path Pc via passing through the right side, in the figure, of branching plate 38B. Then, recording sheet P is detoured and conveyed upward to sheet feed roller 36 to be further conveyed by sheet feed roller 36. Then, color toner images are formed on the second surface of the recording sheet P by image forming section 10, and are heated and fixed by fixing unit 40, and recording sheet P is ejected out of the apparatus by ejection roller 38.

Although the color image forming operation has been exemplified for describing image forming apparatus main body GH in the foregoing, it must be understood that a monochrome image forming operation is also included within the scope of the present invention.

Mounting configuration of secondary transfer section 20 and secondary transfer body motor 26, which drives secondary transfer belt 21 to rotate, according to an embodiment of the present invention will now be described, the mounting configuration which is capable of appropriately suppressing the deterioration of image quality caused by an instantaneous fluctuation of the driving speed of intermediate transfer belt 6 and photoconductive drums 1Y, 1M, 1C, and 1K, and the instantaneous fluctuation which is caused by an impact generated at a time when a recording sheet is fed in or fed out from the secondary transfer area.

Figure 2:
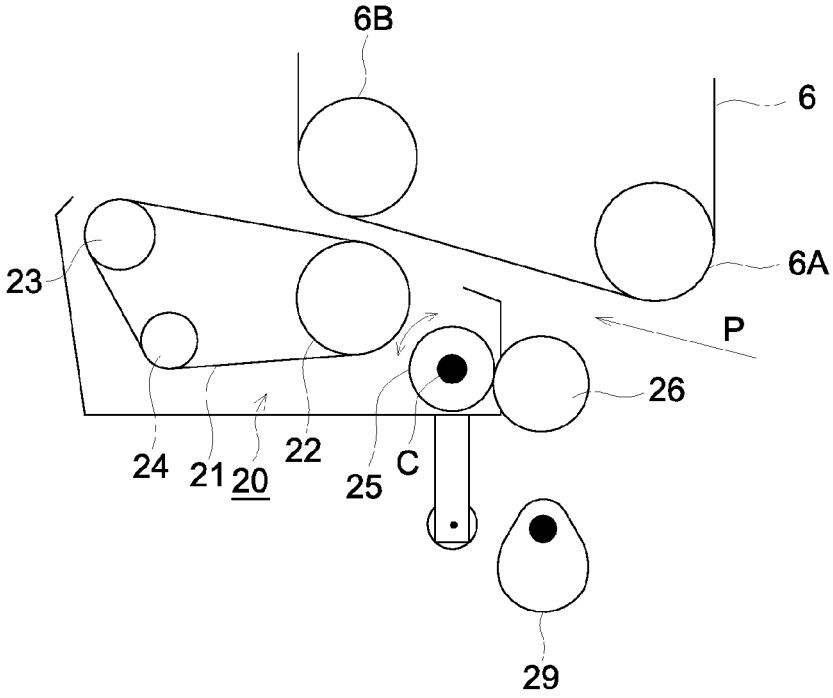
FIG. 2 is a cross-sectional diagram of the vicinity of a secondary transfer section schematically showing an example of standby state before a recording medium is fed into the secondary transfer section.

FIG. 2 is a cross-sectional diagram of the vicinity of secondary transfer section 20 schematically showing an example of standby state before recording sheet P is fed into the secondary transfer section. In other words, FIG. 2 is a diagram schematically showing a state before intermediate transfer belt 6 and secondary transfer belt 21 are brought into contact to form a nip to carry out secondary transfer of toner image from intermediate transfer belt 6 onto recording sheet P.

Intermediate transfer belt 6, which bears superimposed color images thereon, is wound around intermediate transfer belt driving rollers (not shown) and a plurality of intermediate transfer belt rollers 6A, 6B, and the like, and rotates clockwise.

Secondary transfer belt 21 is wound around secondary transfer roller 22, secondary transfer driving roller 23, and tension roller 24.

The driving force of secondary transfer body motor 26 is transmitted to secondary transfer belt 21 via gear 25 which is equipped with the same rotating center of rotation axis C of secondary transfer section 20, which rotates, through a plurality of gears (not shown) as power transmission gears and secondary transfer driving roller 23, and rotates secondary transfer belt 21 counterclockwise.

At a time before each color image is generated by image forming devices 10Y, 10M, 10C, and 10K, secondary transfer driving cam 29 is driven by a secondary transfer section pressure contact motor (not shown) and starts rotating, and then, secondary transfer section 20 is turned upward around rotation axis C as a fulcrum point, and secondary transfer belt 21, which is installed in the interior of secondary transfer section 20, is brought into contact with intermediate transfer belt 6, under pressure.

The secondary transfer section pressure contact motor (not shown) and secondary transfer driving cam 29 function as a mechanism to bring secondary transfer belt 21, of secondary transfer section 20, into contact with intermediate transfer belt 6, and to release the contact. The two-headed arrow shown on the left side of gear 25, in the figure, represents that secondary transfer section 20 turns upward, around rotation axis C as a center of rotation, to bring second transfer belt 21 into contact with intermediate transfer belt 6 under pressure, and turns downward to release the contact.

Figure 3:
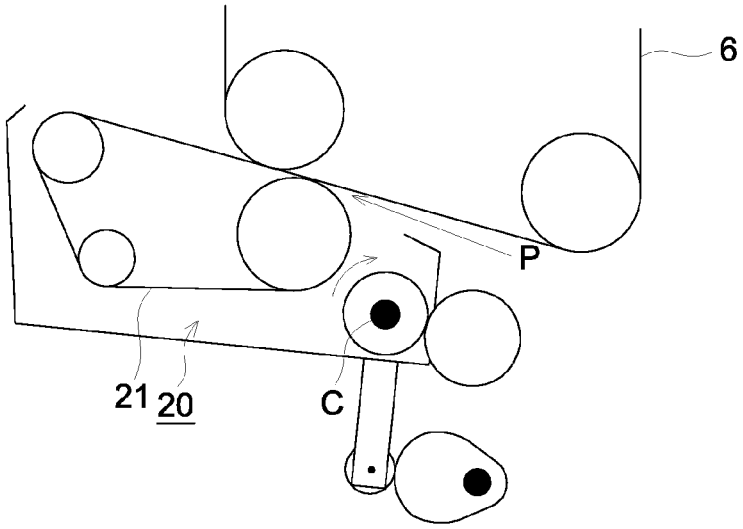
FIG. 3 is a cross-sectional diagram of the vicinity of a secondary transfer section schematically showing an example of state when a recording medium is fed into the secondary transfer section.

FIG. 3 is a cross-sectional diagram of the vicinity of secondary transfer section 20 schematically showing an example of state when recording sheet P is fed into the secondary transfer section. In order words, FIG. 3 is a diagram schematically showing the state in which intermediate transfer belt 6 and secondary transfer belt 21 contact each other under pressure.

Recording sheet P, which has been fed by sheet feeding device 32, is nipped between intermediate transfer belt 6 and secondary transfer belt 21 in the state in which secondary transfer belt 21 and intermediate transfer belt 6 contact each other under pressure.

Figure 4:
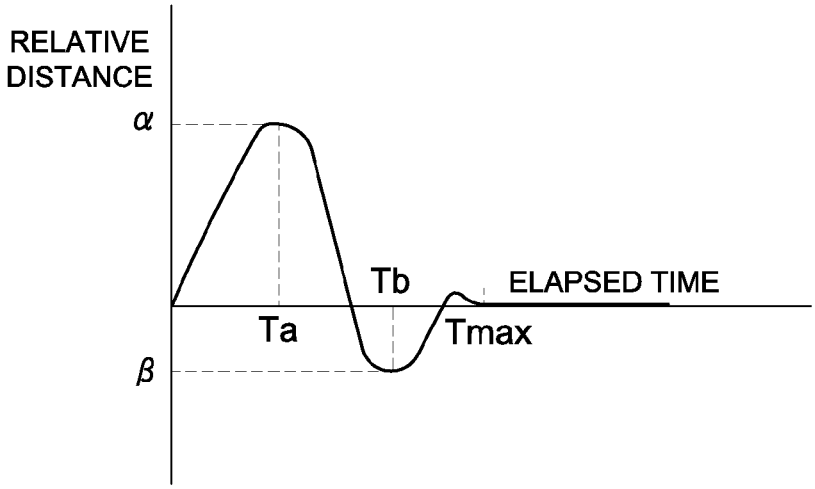
FIG. 4 is a graph showing an example of behavior of the secondary transfer section.

FIG. 4 is a graph showing an example of the behavior of secondary transfer section 20 when an impact is given to secondary transfer section 20 in the state in which secondary transfer belt 21, which is installed in the interior of secondary transfer section 20 which rotates, contacts with intermediate transfer belt 21 under a constant pressure. The vertical axis represents a relative distance between intermediate transfer belt roller 6B and secondary transfer roller 22, and the horizontal axis represents elapsed time. The relative distance between intermediate transfer belt roller 6B and secondary transfer roller 22, before impact is given, is set to zero.

When an impact is giving to secondary transfer section 20, the relative distance increases due to inertia by the impact and reaches to a maximum value $\alpha$. Then, the relative distance reaches $\beta$, though a zero point, due to the pressure given to second transfer section 20. The state of distance $\beta$ represents the state in which intermediate transfer belt 6, intermediate transfer roller 6B, secondary transfer roller 22, and other constitutive members, are deformed by compression due to the pressure.

The maximum value $\alpha$ increases with the weight of second transfer section 20, because inertia increases with the weight of second transfer section 20.

Also, necessary time Ta, to reach the maximum value $\alpha$ increases with the weight of second transfer section 20, and Tb, necessary time to reach $\beta$, increases as well.

As a result, Tmax, which is the necessary time it takes vibrations caused by the impact to dissipate, increases with the weight of second transfer section 20.

The present invention has been made in consideration of the above problems, and it is one of the main objects to reduce the weight of a secondary transfer section by installing a motor, to drive the secondary transfer section to rotate, on the exterior, not in the interior, of the second transfer section, in order to reduce vibrational amplitudes α and β, and to shorten Tmax, which is the time necessary for the vibration, caused by the impact, to dissipate.

By reducing the amplitudes α and β of the vibration caused by the impact and shortening Tmax, necessary time to dissipate the vibration caused by the impact, it is capable of suppressing the instantaneous fluctuation of the driving speed of intermediate transfer belt 6, and also capable of suppressing the instantaneous fluctuation of the driving speed of photoconductive drums 1Y, 1M, 1C, and 1K, which contact with intermediate transfer belt 6. As previously described, a peculiar problem is the impact generated at the moment when a recording medium is fed into or fed out from the nip portion to nip the recording medium for secondary transfer.

EMBODIMENT

Figure 5:
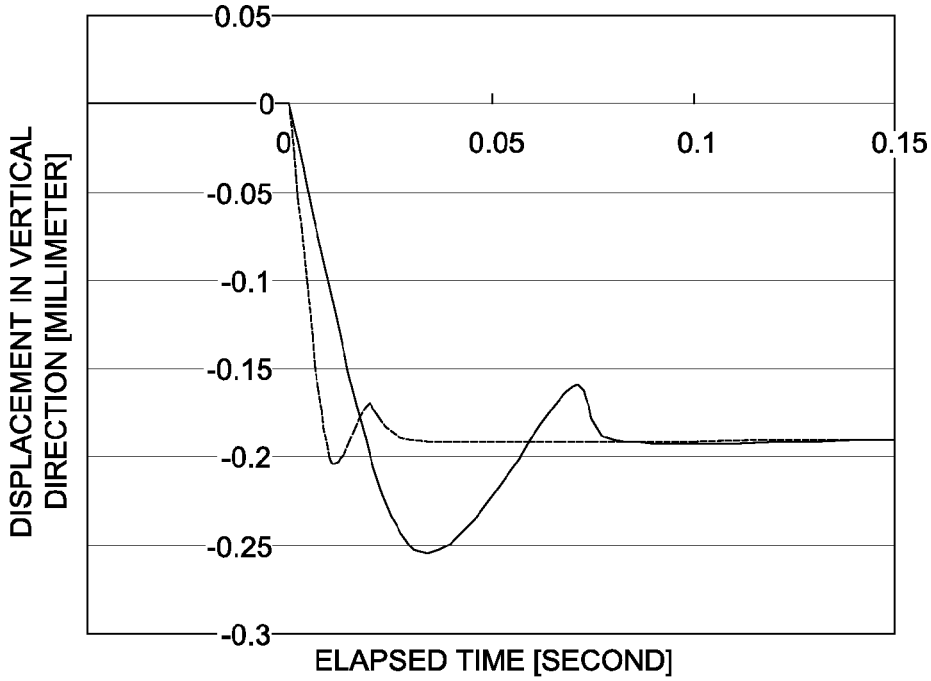
FIG. 5 is a graph showing an example of measurement of behavior of the secondary transfer roller when a recording medium is fed into the secondary transfer section.

FIG. 5 is a graph showing an example of measurement of behavior of secondary transfer roller 22 when a recording medium is fed into the nip portion to nip the recording medium for secondary transfer.

In FIG. 5, the vertical axis represents a vertical displacement of secondary transfer roller 22 in a direction substantially perpendicular to the conveyance surface of recording sheet. The horizontal axis represents elapsed time.

The solid line shows the displacement of secondary transfer roller 22 in a case in which secondary transfer body motor 26, which is the power source to drive secondary transfer belt 21, is installed in the interior of secondary transfer section 20 (hereinafter, referred to as CASE 1). The dotted line shows the displacement of secondary transfer roller 22 in a case in which secondary transfer body motor 26 is installed on the exterior of secondary transfer section 20 (hereinafter, referred as CASE 2).

The displacement of secondary transfer roller 22 in a state in which the vibration by an impact has been dissipated, with recording medium being nipped, was approximately 0.19 mm, that is equivalent to the thickness of the recording medium.

The maximum value α, exceeding the amount which is equivalent to the thickness of the recording medium, was approximately 0.064 mm (measured value (0.254 mm) subtracted by the thickness of recording medium (0.19 mm)) in CASE 1, and approximately 0.015 mm (measured value (0.205 mm) subtracted by the thickness of recording medium (0.19 mm)) in CASE 2. It was improved by approximately 77% in CASE 2 over CASE 1.

Similarly, Tmax, which is the time necessary for the vibration to dissipate, was approximately 0.08 seconds in CASE 1, and approximately 0.03 seconds in CASE 2. It was improved by approximately 64% in CASE 2 over CASE 1.

Figure 6:
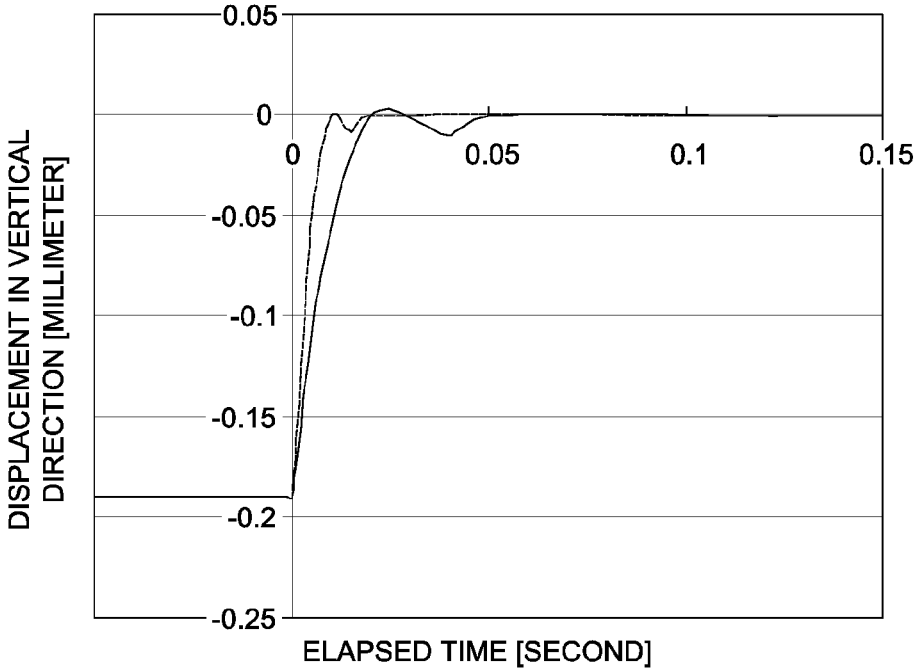
FIG. 6 is a graph showing an example of measurement of behavior of the secondary transfer roller when a recording medium is fed out from the secondary transfer section.

FIG. 6 is a graph showing an example of measurement of behavior of secondary transfer roller 22 when a recording medium is fed out from the nip portion for secondary transfer.

Although the behavior of secondary transfer roller 22, when a recording medium is fed out from the nip portion, was not so intensive as it was when a recording medium is fed into the nip portion (refer to FIG. 5), Tmax, which is the time necessary for the vibration to dissipate, was approximately 0.05 seconds in CASE 1, and approximately 0.02 seconds in CASE 2. It was improved by approximately 60% in CASE 2 over CASE 1.

As it has been described, by installing secondary transfer body motor 26, which drives secondary transfer body (secondary transfer belt 21) being installed in the interior of secondary transfer section 20, on the exterior of second transfer section 20, the vibration, caused by the impact occurred when a recording medium (recording sheet) is fed-into or fed-out from secondary transfer section 20, can be suppressed, and further, the time necessary for the vibration to dissipate, can also be shortened.

Thus, it is possible to appropriately suppress the deterioration of image quality caused by an instantaneous fluctuation of the driving speed of intermediate transfer body (intermediate transfer belt 6) and image bearing members (photoconductive drums 1Y, 1M, 1C and 1K) which are brought into contact with the intermediate transfer body under pressure.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

an image bearing member;

a primary transfer section to transfer a toner image, formed on said image bearing member, onto an intermediate transfer member;

a secondary transfer section, which is provided with a secondary transfer member to secondarily transfer the toner image, formed on said intermediate transfer member, onto a recording medium while said secondary transfer member rotates, and is configured so as to be capable, by rotating around a fulcrum point as a rotation center, of bringing said secondary transfer member into contact with said intermediate transfer member under pressure and then releasing the contact, and of generating a nip between said intermediate transfer member and said secondary transfer member under a pressure contact condition;

a motor to drive said secondary transfer member to rotate;

a driving section which is configured to drive said secondary transfer section so as to bring said secondary transfer member into contact with said intermediate transfer member under pressure, and to release the contact; and a gear which rotates around said fulcrum point as a rotation center;

wherein said motor is not provided inside said secondary transfer section; and wherein the driving force of said motor is transmitted to said secondary transfer member via said gear.

2. The image forming apparatus of claim 1, wherein said secondary transfer section comprises therein a cleaning section to remove a toner on said secondary transfer member after secondary transfer.

* * * * *